US006024040A

United States Patent [19]

Thomas

[11] Patent Number: 6,024,040

[45] Date of Patent: Feb. 15, 2000

[54] OFF-SHORE OIL PRODUCTION PLATFORM

[75] Inventor: Pierre-Armand Thomas, Puteaux, France

[73] Assignee: Technip Geoproduction, Paris la Defense Cedex, France

[21] Appl. No.: 09/000,470

[22] PCT Filed: Jul. 22, 1996

[86] PCT No.: PCT/FR96/01151

§ 371 Date: Jun. 4, 1998

§ 102(e) Date: Jun. 4, 1998

[87] PCT Pub. No.: WO97/05011

PCT Pub. Date: Feb. 13, 1997

[30] Foreign Application Priority Data

Jul. 26, 1995 [FR] France ..... 95 09112

[51] Int. Cl.[7] ..... B63B 35/44

[52] U.S. Cl. ..... 114/264; 114/265

[58] Field of Search ..... 114/230, 264, 114/265, 266

[56] References Cited

U.S. PATENT DOCUMENTS 4,784,529 11/1988 Hunter ..... 114/265
4,864,958 9/1989 Belinsky .
5,012,756 5/1991 Kristensen ..... 114/265
5,588,369 12/1996 Rizkalla et al. ..... 114/195

FOREIGN PATENT DOCUMENTS 2 713 588 6/1995 France .
84/01554 4/1984 WIPO .

*Primary Examiner*—Stephen Avila
*Attorney, Agent, or Firm*—Wenderoth, Lind & Ponack, L.L.P.

[57] ABSTRACT

An off-shore oil production platform of the present invention includes an upper barge (1) stretching above the level of the sea. The barge (1) is connected to a completely submerged hollow lower base (3) by partially submerged connecting legs (2) forming a buoyance tank and stretching substantially vertical. The legs (2) along their submerged height includes at least two successive portions (10, 14). A first portion (10) with solid walls delimits a closed space and forms a buoyancy tank. A second portion (14) with open-work sidewall has an interior space open to a surrounding marine environment.

27 Claims, 2 Drawing Sheets

OFF-SHORE OIL PRODUCTION PLATFORM

The present application is a U. S. national phase application based on and claiming priority from co-pending application Ser. No. PCT/FR96/01151, filed Jul. 22, 1996, which claims priority from French Application 95/09112, filed Jul. 26, 1995.

BACKGROUND OF THE INVENTION

The present invention relates to an off-shore production platform, and especially relates to an off-shore oil production platform which includes an upper barge extending above the level of the sea and being connected to a completely submerged hollow lower base by partially submerged connecting legs forming a buoyancy tank and extending substantially vertically.

Platforms of this type are called semi-submersible platforms. In order to make such platforms stable during production, the lower base is ballasted (for example by filling it with seawater). In known platforms, the legs are formed by cylindrical columns with solid walls delimiting along their entire height a closed space forming a buoyancy tank for the platform.

These platforms do not rest directly on the sea bed and are simply anchored by mooring lines. They are thus very sensitive to swelling of the sea, which causes rising and falling vertical movements of the platform. The amplitude of these movements may reach high values. This phenomenon makes oil production from the platform difficult.

In order to attempt to provide a solution to this problem, it has been proposed to extend the length of the legs so that the base is submerged at a great depth. The result obtained by implementing this solution remains imperfect, and such platforms are complicated to manufacture and to install. Furthermore, they are temporarily unstable during installation.

French patent application FR-A-2,713,588 describes a jack-up platform including legs formed of a metal lattice along their entire height. Floats built into the legs allow the platform to be made buoyant. However, they are not intended to reduce the vertical movements of the platform.

SUMMARY OF THE INVENTION

An object of the present invention is to propose an off-shore production platform which is not very sensitive to swelling, and in which the length of legs connecting an upper barge to a lower base is limited.

To this end, an object of the invention is an off-shore production platform, especially an off-shore oil production platform (of the aforementioned type) which comprises legs that include at least two successive portions along their submerged height. A first portion has solid walls delimiting a closed space and forms a buoyancy tank. A second portion has an openwork sidewall that includes an interior space open to a surrounding marine environment.

According to specific embodiments, the invention may have one or more of the following features:

the second portion with the openwork sidewall has a metal lattice structure;

the second portion with the openwork sidewall is arranged between the first portion having solid walls and the base;

the first portion having solid walls extends at least partially immediately below the barge;

the first portion and second portion have dimensions such that over a usual swell range period, a pressure force exerted on the first portion with solid walls substantially compensates for an acceleration force of the platform;

the first portion and second portion have dimensions such that for two values of a swell period lying within the usual swell period range, the pressure force and the acceleration force are equal;

the smallest value of the swell period for which the pressure force and the acceleration force are equal is greater than 4 seconds;

the submerged height of the second portion lies between one quarter and three quarters of the total submerged height of the leg;

the submerged height of the second portion lies between substantially 0.4 and substantially 0.65 times the total submerged height of the leg;

the legs have a cylindrical external overall shape;

the base includes at least one passage passing substantially vertically right through it;

the base is filled with a fluid forming a ballast, and particularly with seawater;

the barge is mounted so that it can be moved along the legs and mechanisms are provided for the relative movement and locking of the barge with respect to the legs; and the second portion having the openwork sidewall is arranged between two portions with solid walls along the submerged height of the legs.

BRIEF DESCRIPTION OF THE DRAWINGS

The invention will be better understood from reading the description (which will follow), given merely by way of example, and made with reference to the following drawings.

DESCRIPTION OF THE PREFERRED EMBODIMENTS

Figure 1:
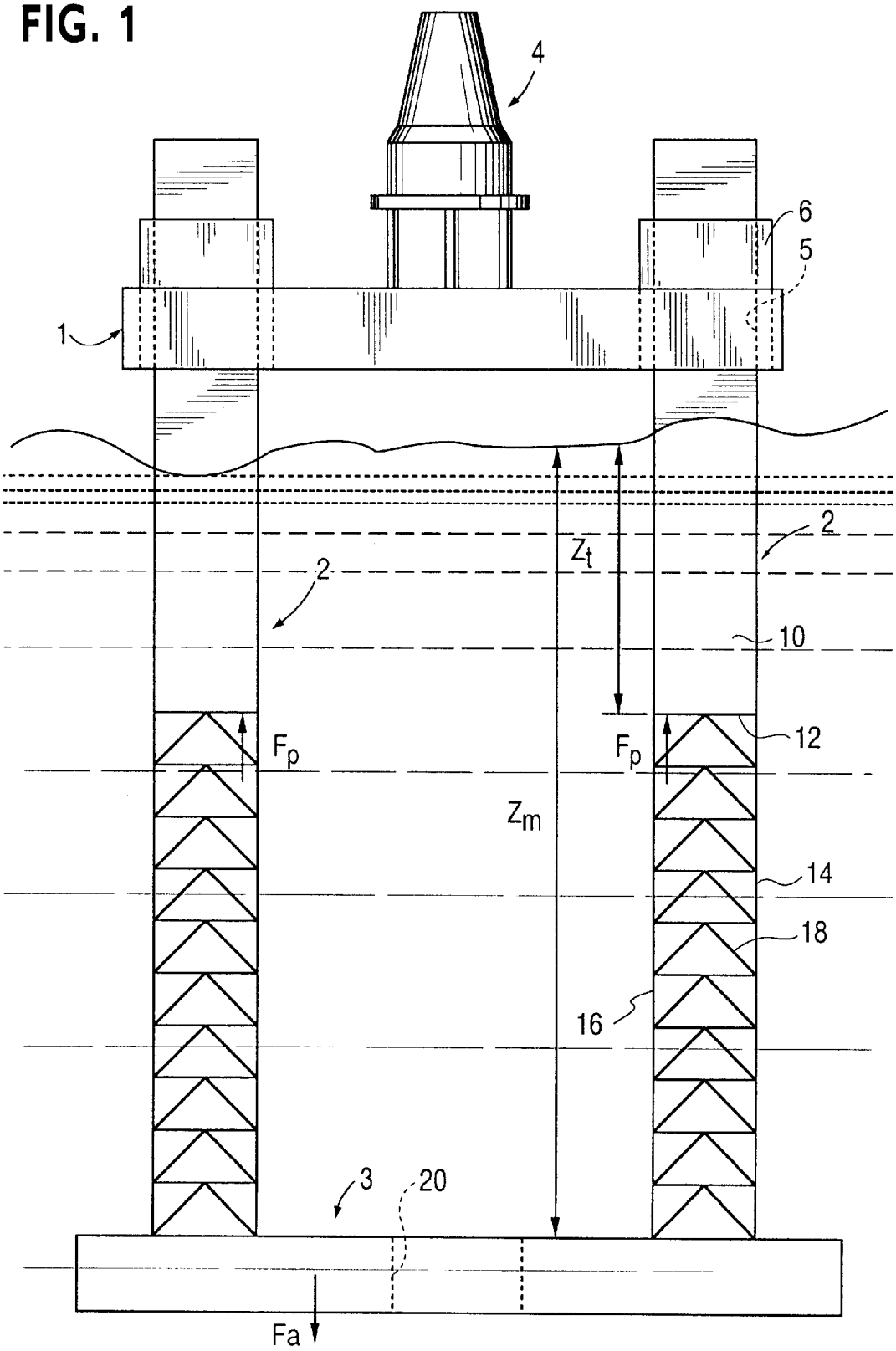
FIG. 1 is an elevation view of an oil platform in accordance with the invention.

Represented diagrammatically in FIG. 1 is a jack-up oil platform of a semi-submersible type. It essentially includes an upper barge 1 extending above the sea when the platform is in production mode, and it is connected by legs 2 to a submerged lower base 3.

Conventionally, the upper barge 1 includes technical buildings, accommodation quarters (not represented), and a drilling well and wellheads 4.

Moreover, passages 5 are formed through the barge 1 to allow the passage of the legs 2. Lifting mechanisms 6 are arranged around the passages 5 and allow the legs 2 and the base 3 to be lowered and the barge 1 to be winched up above the surface of the water to an altitude which places the barge 1 out of reach of the highest waves. The mechanisms 6 are, for example, rack and pinion mechanisms. The racks stretch along the entire length of the legs 2. These mechanisms 6 further include a means for locking the legs 2 to the barge 1 in order to provide a rigid connection between the legs and the barge.

There are, for example, four legs 2. The legs 2 have cylindrical external overall shapes. In the embodiment represented in FIG. 1, they have square cross-sections, but they may just as easily have circular or triangular cross-sections.

The legs 2 are all identical and along their submerged height have two successive portions. A first upper portion 10 is formed by a tube with a solid wall closed off at its lower end by a bottom 12. This first portion 10 thus delimits a closed space isolated from a surrounding marine environment and forms a buoyancy tank for the platform. An upper part of this first portion 10 stretches above the level of the sea on both sides of the barge 1. Its lower part stretches immediately below the barge 1 and is partially submerged.

The first portion 10 is connected to a second portion 14 with an openwork sidewall. The inside of this second portion 14 is open to the surrounding marine environment. This second portion 14 is thus interposed between the first portion 10 and the base 3. The second portion 14 is formed, for example, of a metal lattice structure. This structure includes four metal uprights 16 joined together by a lattice 18 of metal tubes.

The second portion 14 is welded at its upper end to the lower end of the first portion 10. The lower end of the second portion 14 is welded to the base 3.

As represented in FIG. 1, in a production position, a submerged height Zt of the first portion 10 with solid wall represents substantially one third of a total submerged height Zm of the legs 2. Thus, the second lattice-work portion 14 is completely submerged and extends, in the represented embodiment, over substantially two thirds of the total submerged height Zm of the legs 2. In general, the submerged height of the second portion 14 lies between one quarter and three quarters of the total submerged height Zm of the legs 2.

In practice, calculations show that the submerged height of the second portion 14 generally lies between substantially 0.4 and substantially 0.65 times the total submerged height Zm of the legs 2.

The base 3 is hollow and has a square, rectangular or triangular overall cross-sectional shape. It is filled with seawater and thus forms ballast for the entire platform. It may also include reservoirs incorporated within it and in which hydrocarbons are stored. Furthermore, a central passage 20 passes right through the base 3. This passage 20 reduces a resistive surface size in the water during vertical movements of the platform. It may also allow drilling tools to run through it.

In the position represented in FIG. 1, the platform floats due to the submerged part of the first solid-walled portions 10. These portions 10 are subjected to a pressure force denoted $F_p$ exerted on their bottoms 12. The pressure force $F_p$ depends on the submerged height Zt of the first portions 10.

It may be expressed, to a first approximation, in the form:

$$F_p = A_\omega e^{\beta Zt} f(t)$$

Where:

$A_\omega$ is the area of the buoyancy surface (the area of the bottoms 12), β is the wave number of the swell and f(t) is the rise in level of the free surface of the sea as a function of time.

Furthermore, the entire platform is subjected to an acceleration force denoted $F_a$, which is due mainly to movement of the water and especially to their affects on the lower base 3. This acceleration force depends on the total submerged height Zm of the legs 2. It may be expressed, to a first approximation, in the form:

$$F_a = k_1 B e^{\beta Zm} f(t)$$

Where:

$k_1$ is a constant for a given swell period and B is the sum of the mass of the lower base 3 filled with water and an added mass. The added mass is a fictitious mass taking account of the action of the seawater surrounding the lower base 3 on the platform as the latter moves.

The two forces $F_a$ and $F_p$ applied to the platform are opposite in phase. In these conditions, it will be understood that it is possible to have the first and second portions dimensioned such that the submerged height Zt of the first portion 10 is such that, over the usual swell period range, the pressure force $F_p$ exerted on this first portion 10 substantially compensates for the acceleration force $F_a$ of the platform. In addition, the dimensions may be such that for two swell period values lying within the usual range of swell periods, these two forces ($F_a$ and $F_p$) are equal.

To this end, when dimensioning the platform, a floating surface (a surface of intersection of the legs with the surface of the water) and the volume of the base are first determined. By a conventional stability approach, the total submerged height Zm required for the legs 2 is then determined 7.

The submerged height Zt of the first portion 10 with the solid wall is determined by solving the equation in which the forces $F_a$ and $F_p$ applied to the platform are equalized.

Using a computer simulation of the behaviour of the platform, it is then verified that the two values of the swell period for which the forces $F_a$ and $F_p$ are equal do lie within the usual swell period range. In particular, it is verified that the smallest value of the swell period, in which the two forces are equal, is greater than 4 seconds.

If such is not the case, a new calculation of the heights Zm and Zt is performed with the base 3 having a different volume or a different shape. Changing the structure of the base 3, particularly changing its shape, changes the added mass. The heights Zm and Zt are changed for the values of the swell period in which the two forces $F_a$ and $F_p$ are equal.

Figure 2:
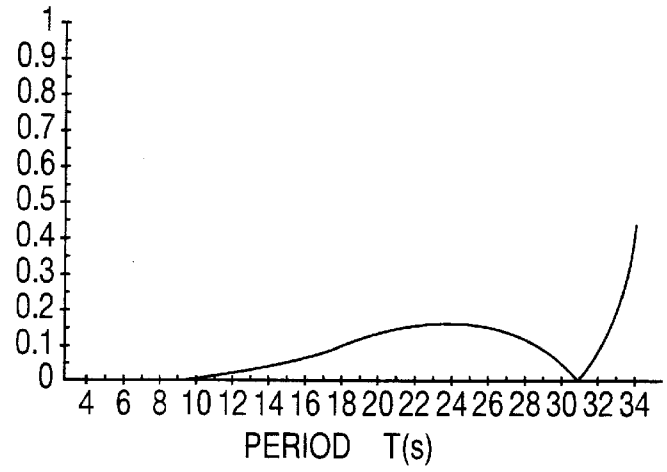
FIG. 2 is a graph representing the transfer function of a platform known in the art as a function of swell period.

Represented in FIG. 2 is a transfer function of a platform known in the art (one with legs formed of a single solid-walled portion stretching from the base 3 to the barge 1), as a function of the swell period T expressed in seconds. The transfer function in heave is the ratio between the amplitude of the pounding movement of the platform and a swell with an amplitude of one meter. The heave has a magnitude representative of the rising and falling vertical movements of the platform under the swelling effects.

It will be observed from this curve that the heave of the platform is greater over a range of periods of 18 to 28 seconds. This range of periods corresponds to the high swell period values commonly encountered. Furthermore, the heave is extremely great for swell periods of close to 24 seconds.

Figure 3:
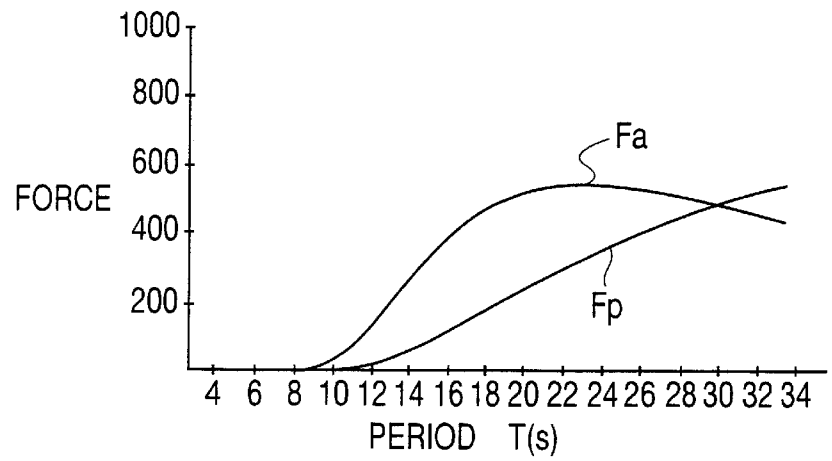
FIG. 3 is a graph representing a change in pressure force and in acceleration force exerted on a platform known in the art as a function of the swell period.

Represented in FIG. 3 are the pressure force $F_p$ and in acceleration force $F_a$ as a function of the swell period T expressed in seconds for a platform known in the art. It may be observed from these curves that the amplitudes of the forces $F_a$ and $F_p$ are very great for a given period of less than 28 seconds. Furthermore, the difference between the values of the forces $F_a$ and $F_p$ are great. Thus, the platform is subjected mainly to the acceleration force $F_a$, and this results in the great heave seen in the curve of FIG. 2. For a period substantially equal to 31 seconds, the values of $F_a$ and $F_p$ are substantially equal, which corresponds to a substantially nonexistent heave in FIG. 2.

Figure 5:
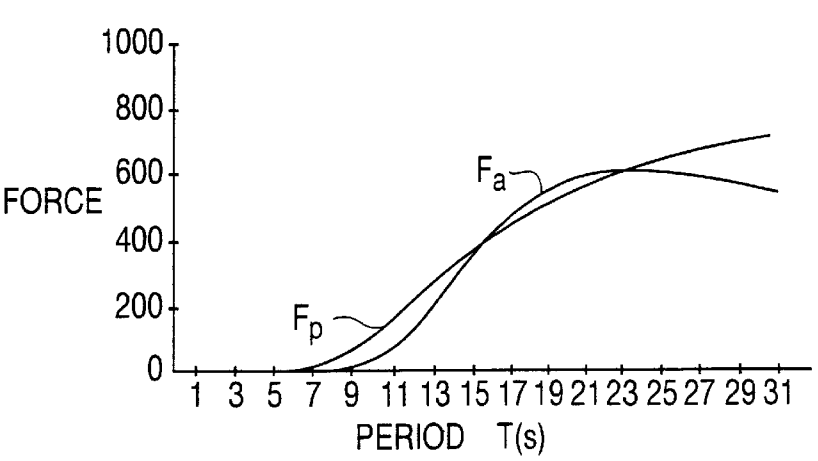

For the platform according to the invention, represented in FIG. 1, the transfer function is represented in FIG. 5.

It may be observed from FIG. 5 that by virtue of the design of the legs as two successive portions one of which has solid walls and the other of which has an openwork sidewall, it is possible for the values of the forces $F_a$ and $F_p$ to be brought very close to one another for a wide range of swell periods lying between 0 and 24 seconds, which corresponds to the usual swell range. Furthermore, the curves representing the forces $F_a$ and $F_p$ intersect at two points over this range of values (these forces are in phase opposition). These two points correspond to a cancelling-out of the resultant excitation force applied to the platform.

Figure 4:
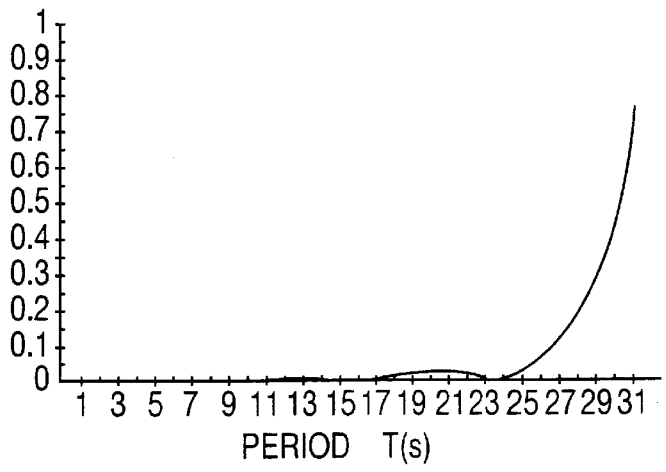
FIGS. 4 and 5 are graphs similar to those of FIGS. 2 and 3 for a platform according to the invention.

It will be observed from FIG. 4 that since the acceleration force $F_a$ and the pressure force $F_p$ compensate for one another substantially over the entire range of periods corresponding to usual swells, the heave of the platform is very low. In particular, the maximum heave obtained in this range corresponds to substantially ⅙th of the maximum heave obtained with platforms known in the art.

Furthermore, in FIG. 4 the curve cancels itself out for two different periods T (at 15.5 seconds and 23.5 seconds) and not just at one value as in the case of known platforms. These two cancelling-out values are the result of the two points of intersection for the curves representing the acceleration force $F_a$ and the pressure force $F_p$.

The curves represented in FIG. 5 were obtained with a platform with the submerged height Zt of the first portion 10 equal to 50 m and the total submerged length Zm of the legs 2 equal to 140 m. The volume of the lower base 3 was equal to 33,000 $m^3$, and the surface area of the floating surface (sum of the areas of the bottoms 12) was equal to 841 $m^2$. The added mass of the platform was equal to 194,750 tonnes.

Another alternative (not represented) is to interpose between the lower end of the lattice-work portions 14 and the base 3 additional solid-walled portions forming additional buoyancy tanks or storage tanks for the platform. In these conditions, the lattice-work portions 14 are arranged between two solid-walled portions along the submerged height of the legs.

Moreover, any other arrangement of successive portions, some of which have solid walls and others of which have openwork sidewalls, is also possible when producing the legs 2 for the platform.

It will be noted that with this type of platform, the length of the legs 2 is independent of the depth of the production site.

Further, the good stability of the platform allows wellheads to be installed on the barge 1.

I claim:

1. A platform used in a marine environment, comprising:

an upper barge;

substantially vertical connecting legs connected to said barge, said legs including first portions and second portions, said first portions including solid walls forming buoyancy tanks, and said second portions including openwork sidewalls and interiors open to the marine environment;

a hollow lower base connected to said connecting legs; and wherein said first portions and said second portions have dimensions so that a pressure force exerted by the marine environment on said first portions substantially compensates for an acceleration force exerted by the marine environment on said lower base over a usual swell period range of the marine environment when deployed in the marine environment.

2. The platform according to claim 1, wherein said second portions include metal lattice structures.

3. The platform according to claim 2, wherein said legs include third portions, said third portions include solid walls forming third portion buoyancy tanks, and said second portions are arranged between said first portions and said third portions in said legs.

4. The platform according to claim 1, wherein said second portions are arranged between said first portions and said base.

5. The platform according to claim 4, wherein said legs include third portions, said third portions include solid walls forming third portion buoyancy tanks, and said second portions are arranged between said first portions and said third portions in said legs.

6. The platform according to claim 1, wherein said first portions extend at least partially and immediately below said barge.

7. The platform according to claim 6, wherein said legs include third portions, said third portions include solid walls forming third portion buoyancy tanks, and said second portions are arranged between said first portions and said third portions in said legs.

8. The platform according to claim 1, wherein said first portions and said second portions have dimensions so that said pressure force and said acceleration force are equal at two values over said usual swell period range.

9. The platform according to claim 8, wherein said legs include third portions, said third portions include solid walls forming third portion buoyancy tanks, and said second portions are arranged between said first portions and said third portions in said legs.

10. The platform according to claim 8, wherein said two values over said usual swell period range include a smallest value, said first portions and said second portions having dimensions so that said smallest value is greater than 4 seconds.

11. The platform according to claim 10, wherein said legs include third portions, said third portions include solid walls forming third portion buoyancy tanks, and said second portions are arranged between said first portions and said third portions in said legs.

12. The platform according to claim 1, wherein when deployed in the marine environment said legs have a total submerged height and said second portions have a submerged height between one quarter and three quarters of said total submerged height.

13. The platform according to claim 12, wherein said legs include third portions, said third portions include solid walls forming third portion buoyancy tanks, and said second portions are arranged between said first portions and said third portions in said legs.

14. The platform according to claim 12, wherein said submerged height of said second portions lies substantially between 0.4 and 0.65 times of said total submerged height.

15. The platform according to claim 14, wherein said legs include third portions, said third portions include solid walls forming third portion buoyancy tanks, and said second portions are arranged between said first portions and said third portions in said legs.

16. The platform according to claim 1, wherein said legs have cylindrical external shapes.

17. The platform according to claim 16, wherein said legs include third portions, said third portions include solid walls forming third portion buoyancy tanks, and said second portions are arranged between said first portions and said third portions in said legs.

18. The platform according to claim 1, wherein said base includes a substantially vertical passage defined through said base.

19. The platform according to claim 18, wherein said legs include third portions, said third portions include solid walls forming third portion buoyancy tanks, and said second portions are arranged between said first portions and said third portions in said legs.

20. The platform according to claim 1, wherein said base is filled with a fluid forming a ballast.

21. The platform according to claim 12, wherein said fluid includes seawater.

22. The platform according to claim 21, wherein said legs include third portions, said third portions include solid walls forming third portion buoyancy tanks, and said second portions are arranged between said first portions and said third portions in said legs.

23. The platform according to claim 1, wherein said barge includes lifting mechanisms provided on said barge and said legs for moving said barge relative to said legs, said lifting mechanisms include locking mechanisms provided on said barge and said legs for locking said legs to said barge.

24. The platform according to claim 23, wherein said lifting mechanisms include rack and pinion mechanisms, said rack and pinion mechanisms include racks provided on said legs.

25. The platform according to claim 23, wherein said legs include third portions, said third portions include solid walls forming third portion buoyancy tanks, and said second portions are arranged between said first portions and said third portions in said legs.

26. The platform according to claim 1, wherein said legs include third portions, said third portions include solid walls forming third portion buoyancy tanks, and said second portions are arranged between said first portions and said third portions in said legs.

27. The platform according to claim 1, wherein when deployed in the marine environment said first portions have a submerged length of 50 m, and said legs have a total submerged length of 140 m.

* * * * *